US005999150A

United States Patent [19]

Nighan et al.

[11] Patent Number: 5,999,150

[45] **Date of Patent: *Dec. 7, 1999**

[54] ELECTROLUMINESCENT DISPLAY HAVING REVERSIBLE VOLTAGE POLARITY

[75] Inventors: William L. Nighan, Manchester; Fred A. Otter, Storrs; Russell A. Budzilek, Bridgeport, all of Conn.

[73] Assignee: Northrop Grumman Corporation, Los Angeles, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/634,105

[22] Filed: Apr. 17, 1996

[51] Int. Cl.[6] ..... G09G 3/30

[52] U.S. Cl. ..... 345/79; 345/77; 345/209

[58] Field of Search ..... 345/76, 79, 77, 345/208, 209, 96

[56] References Cited

U.S. PATENT DOCUMENTS

| | | | |
|---|---|---|---|
| 4,554,539 | 11/1985 | Graves | 345/76 |
| 4,801,920 | 1/1989 | Ohba et al. | 345/78 |
| 4,866,348 | 9/1989 | Harada et al. | 345/79 |
| 4,975,691 | 12/1990 | Lee | 345/79 |
| 5,093,655 | 3/1992 | Tanioka et al. | 345/209 |
| 5,627,556 | 5/1997 | Kwon et al. | 345/78 |

FOREIGN PATENT DOCUMENTS

| | | | |
|---|---|---|---|
| 401306896 | 12/1989 | Japan | 345/79 |

*Primary Examiner*—Bipin H. Shalwala
*Assistant Examiner*—Ricardo Osorio

[57] ABSTRACT

An electroluminescent display having reversible polarity and a method for reducing latent images in the electroluminescent panel is provided. The electroluminescent display includes a waveform generator for supplying voltage pulses to illuminate pixels within the electroluminescent panel. The electroluminescent display according to the invention periodically reverses the polarity of the voltage pulses to reduce latent images in the electroluminescent panel. The electroluminescent display preferably utilizes an asymmetrical drive scheme to provide a brighter electroluminescent display.

16 Claims, 3 Drawing Sheets

FIG. 1
PRIOR ART
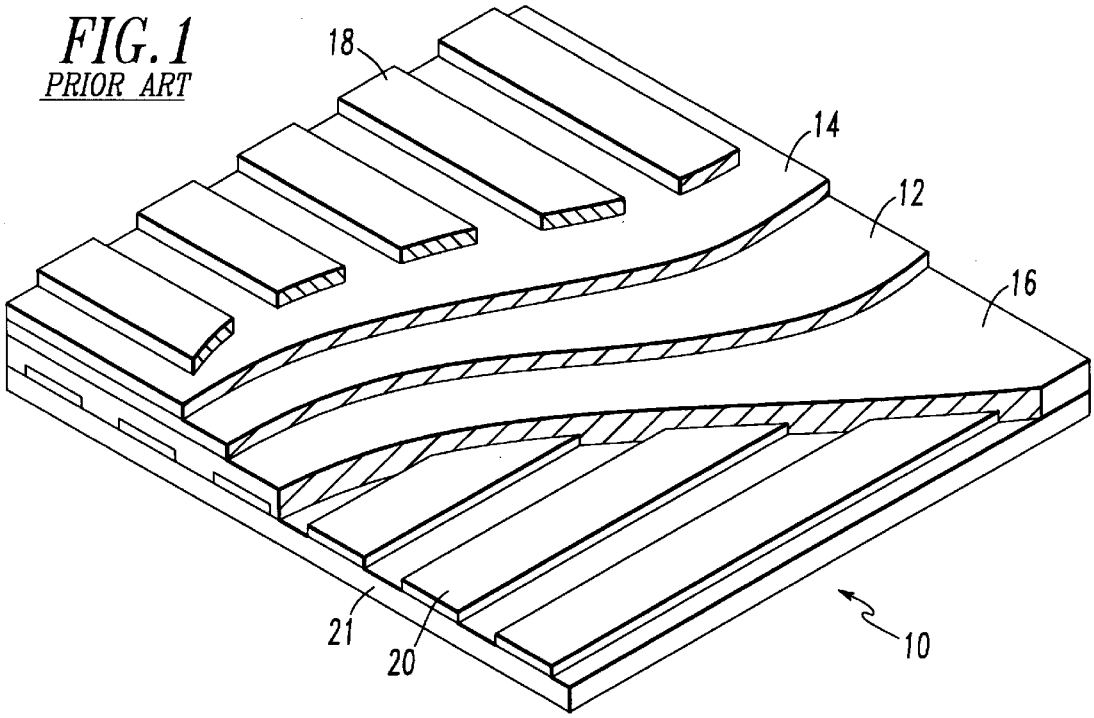
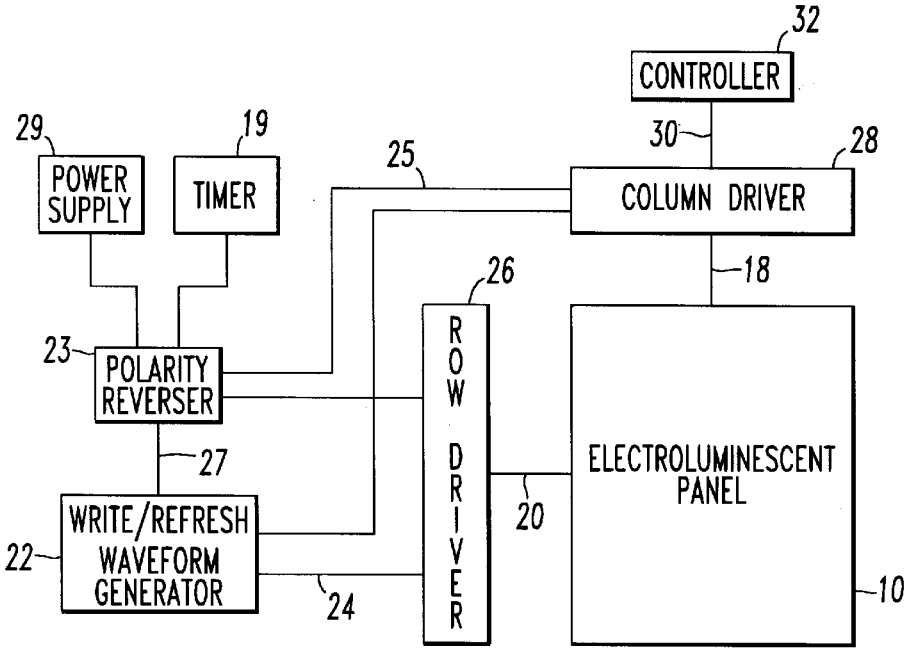
FIG. 2

TIME
VOLTAGE
200
100
-100
-200
Tr
2Tr
48
49
50a
50b
50c
50d
51a
51b
51c
52a
52b
52c
53a
53b
38a
38b
38c
38d

VOLTAGE
200
100
-100
-200
Tr
2Tr
48
49
50a
50b
51a
51b
52b
52c
53a
53b
38a
38b
38c
38d

ELECTROLUMINESCENT DISPLAY HAVING REVERSIBLE VOLTAGE POLARITY

BACKGROUND OF THE INVENTION

1. Field of Invention

This invention relates to electroluminescent displays, and more particularly to an electroluminescent display having reversible polarity for creating images on an electroluminescent panel.

2. Description of the Prior Art

Electroluminescent displays represent a class of flat panel displays that are used in a wide variety of applications. For example, the displays are currently used in military systems, elevators and hospital monitoring equipment.

Electroluminescent displays generally include an electroluminescent layer such as a ZnS phosphor doped with an activator such as Mn. The electroluminescent layer is placed between two dielectric layers. A first series of parallel and longitudinal electrodes adjoin the first dielectric layer and a second series of parallel and longitudinal electrodes adjoin the second dielectric layer in an orthogonal orientation with respect to the first series of electrodes.

The first series of electrodes may be referred to as row electrodes and the row electrodes may be constructed of aluminum. The second series of electrodes may be referred to as column electrodes. The column electrodes are typically transparent and made of indium-tin oxide.

An intersection of the first series and second series of electrodes defines a picture element referred to as a pixel. The resolution of the electroluminescent display is determined from the number of pixels.

The electroluminescent displays operate by applying a voltage across the electroluminescent layer via the first series and second series of electrodes. Each pixel within the electroluminescent layer will emit light when a sufficient voltage is present between the electrodes which correspond to the pixel. The luminescence of the particular pixel will be determined from the magnitude of the voltage across the pixel.

Electroluminescent displays may suffer from a problem referred to as a 'latent image' or 'retained image' phenomenon. This phenomenon results in smearing and ghost images wherein an image which has been displayed for a long period of time may be burned into the display (i.e. the image is apparent to varying degrees even though it is not electrically written on the display). Accordingly, this problem is most severe in areas of the electroluminescent layer which are subject to the greatest use. These images may appear only after a few hours or several days or months depending upon the technology and electronic voltage drive scheme utilized.

It is believed that the basic cause of this phenomenon is the occurrence of sulfur vacancies within the Mn-doped ZnS phosphor. These sulfur vacancies diffuse in a non-uniform manner within the phosphor with the passage of time and thereby change the electrostatics of the device.

This theory is supported by the fact that the occurrence of a latent image is greatly dependent upon the electronic voltage drive scheme. It appears that the latent image phenomenon is a result of the pixels having a voltage-time average that is non-zero when averaged over several scans through the model. The non-zero voltage-time average causes an asymmetrical charge distribution to be built up over time and possibly a spatially preferential accumulation of sulfur vacancies within the phosphor.

One approach to reduce the severity of the latent image phenomenon is to utilize a symmetric voltage drive scheme. Symmetric voltage drive schemes are well known in the art and operate by first generating a plurality of positive voltage pulses followed by a plurality of negative voltage pulses which are equal in magnitude to the corresponding positive voltage pulses. The average electric field within the ZnS phosphor approaches zero when a symmetric waveform is used to drive the electroluminescent display and there is no spatially preferential accumulation of sulfur vacancies within the phosphor.

However, the use of a symmetric voltage drive scheme is undesirable inasmuch as pixel brightness is reduced up to 50% as compared to the use of an asymmetrical voltage drive scheme. This reduction in brightness of the electroluminescent display is unacceptable when high ambient viewability is required. It has also been noticed that a symmetric voltage drive scheme may cause a ghosting phenomenon in certain display modes such as scrolling characters across a display. In addition, the response time of an electroluminescent display which is driven by a symmetric voltage drive scheme is slower than an electroluminescent display driven by an asymmetrically driven electroluminescent display.

Asymmetrical voltage drive schemes are also well known in the art. These voltage drive schemes operate by generating a first refresh voltage pulse which is followed by a plurality of write voltage pulses corresponding to a first write cycle. The first write cycle may be followed by a second refresh pulse and a second write cycle and the pattern is repeated. The refresh pulses have a polarity which is opposite that of the write pulses. The use of asymmetrical voltage drive schemes offers the advantages of faster response time and a brighter electroluminescent display without the ghosting phenomenon in certain display modes.

Despite the advantages of an asymmetrical drive scheme, the magnitude of the opposite polarity drives are not equal and a charge may accumulate at an interface of the electroluminescent layer and a dielectric layer resulting in the appearance of ghost images within the electroluminescent display.

SUMMARY OF THE INVENTION

The invention provides for an electroluminescent display and a method of driving the same. In particular, the electroluminescent display is preferably driven with an asymmetric voltage drive scheme which eliminates the development of a preferential charge distribution at specific pixel sites.

The electroluminescent display in accordance with the present invention includes an electroluminescent layer for generating images and a plurality of first electrodes adjacent a first side of the electroluminescent layer and a plurality of second electrodes adjacent a second side of the electroluminescent layer and orientated to intersect the first electrodes.

The electroluminescent display in accordance with the present invention may further include a waveform generator for preferably applying refresh voltage signals and write voltage signals to the electroluminescent layer via the first and second electrodes.

The electroluminescent display in accordance with the present invention preferably reverses the polarity of the refresh voltage signals and the write voltage signals after a predetermined transition time to reduce latent images within the electroluminescent display.

The preferred usage of an asymmetrical drive scheme in accordance with the present invention provides a brighter electroluminescent display which has a faster response time.

BRIEF DESCRIPTION OF THE DRAWINGS

FIG. 1 is a sectional view of a portion of a prior art electroluminescent display panel.

FIG. 2 is a block diagram of a present preferred embodiment of an electroluminescent display panel and the corresponding voltage drive scheme components.

DETAILED DESCRIPTION OF THE PREFERRED EMBODIMENTS

Figure 3:
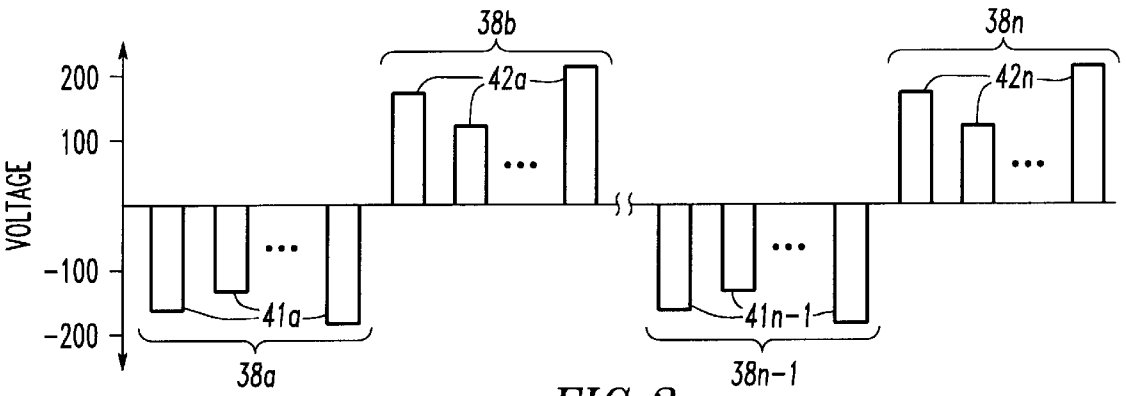
FIG. 3 PRIOR ART
FIG. 3 is a plot of a waveform of a typical prior art symmetrical voltage drive scheme.

As shown in FIG. 1, an electroluminescent panel 10 includes an electroluminescent layer 12 which is positioned between a first dielectric layer 14 and a second dielectric layer 16. The first dielectric layer 14 and the second dielectric layer 16 act as capacitors to protect the electroluminescent layer 12 from DC electrical currents. The electroluminescent panel 10 further includes a plurality of first electrodes 18 adjacent the first dielectric layer 14, and a plurality of second electrodes 20 adjacent the second dielectric layer 16 and a glass substrate 21. The second electrodes 20 are preferably transparent and constructed of indium-tin oxide (ITO).

The electroluminescent layer 12 may be a Mn-doped ZnS phosphor. Electrons flow between the first electrodes 18 and the second electrodes 20 when the difference in voltage between the first electrodes 18 and second electrodes 20 exceeds a threshold voltage (e.g. 160 volts). The electrons traveling between the first electrodes 18 and the second electrodes 20 excite the Mn within the electroluminescent layer 12 and photons are thereby emitted through the second dielectric layer 16 and the second electrodes 20 to form an image upon the glass substrate 21.

The drive circuitry for the electroluminescent panel 10 is shown in FIG. 2. The drive circuitry preferably includes a waveform generator 22 for producing voltage signals or pulses to drive the electroluminescent panel 10. The driver circuitry also includes a row driver 26 and a column driver 28 connected with the waveform generator 22.

The electroluminescent panel 10 may be preferably driven in a conventional manner utilizing a row-at-a-time scheme. In particular, the waveform generator 22 applies a voltage waveform to the row driver 26 via a first line 24. The voltage waveform preferably has a magnitude approximately equal to the threshold voltage of the electroluminescent panel 10.

The row driver 26 preferably operates in a successive order to sequentially apply the threshold voltage waveform to each row of pixels within the electroluminescent panel 10 via the first electrodes 18. The row driver 26 may include a shift register to provide the preferred sequential operation. A write cycle 38 is complete when each row of pixels within the electroluminescent panel 10 has received the threshold voltage.

The waveform generator 22 may additionally provide a voltage waveform to the column driver 28 via a second line 25. The voltage waveform applied to the column driver 28 may be a fixed constant voltage drive pulse (e.g. 60 volts DC) if the electroluminescent display is operating as a graphics panel.

Alternatively, the waveform generator 22 may include a ramp voltage generator for applying a variable amplitude drive pulse (60 volts DC ramp) to the column driver 28 if the electroluminescent display is operating as a gray-scale panel. The luminescence of each individual pixel may be varied through the utilization of a ramp voltage generator and regulating the magnitude of the voltage applied to each of the pixels. In particular, the column driver 28 may operate as a sample-and-hold device wherein the ramped voltage is sampled and retained at a predetermined time depending upon the desired luminance of the pixel.

The column driver 28 may receive address, data and clock information from a controller 32 via a bus 30. The controller 32 applies a plurality of parallel data signals to the column driver 28 to control the timing of the sampling of the ramp voltage thereby. Each instantaneously sampled voltage is subsequently applied to an individual pixel via the second electrodes 20 thereby controlling the luminescence of the pixel and permitting gray-scaling. This procedure is repeated for each row of pixels in the electroluminescent panel 10 to complete a write cycle 38. The write cycles 38 are subsequently repeated to create visual images on the electroluminescent panel 10.

A plot of a prior art symmetrical waveform for driving the pixels is shown in FIG. 3. In particular, a plurality of first negative write voltages 41*a* are applied to the pixels during a first write cycle 38*a*. Next, a plurality of first positive write voltages 42*a*, which may be equal in magnitude to the first negative write voltages 41*a*, are applied to the pixels during a second write cycle 38*b*. The polarity of each write cycle 38 continues to alternate throughout the operation of a symmetrical voltage drive scheme. Alternatively, the symmetrical voltage drive scheme may reverse the polarity of the voltage pulses after every other voltage pulse or every nth voltage pulse.

Utilizing a symmetric voltage drive scheme greatly reduces the latent image phenomenon because alternating the polarity of the voltage pulses reduces an electrical charge being accumulated at the interface of the first dielectric layer 14 or the second dielectric layer 16.

Figure 4:
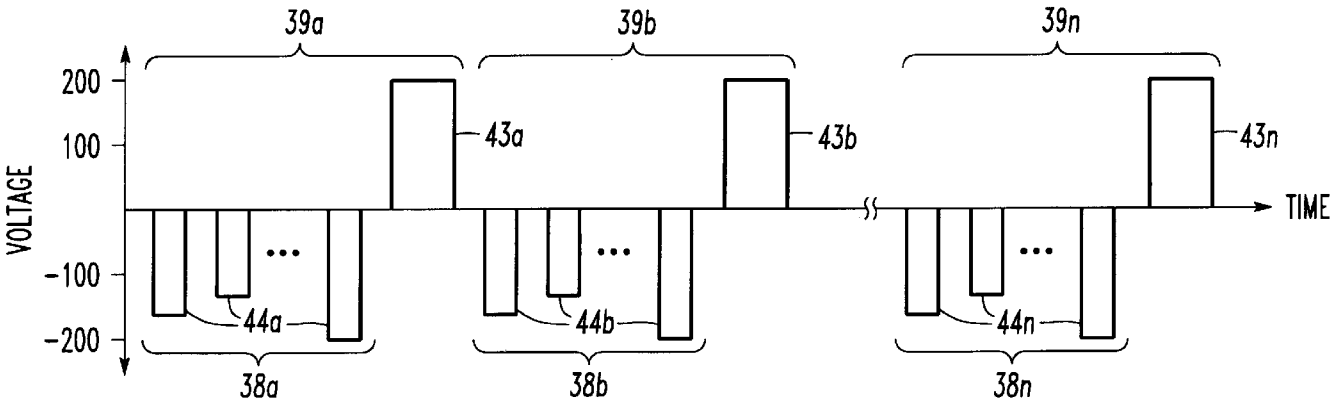
FIG. 4 is a plot of a waveform of a typical prior art asymmetrical voltage drive scheme.

A plot of a typical prior art asymmetrical waveform for driving the electroluminescent panel 10 is shown in FIG. 4. In particular, a plurality of first write pulses 44*a* are applied to the pixels within the electroluminescent panel 10. The number of write pulses 44*a* within each write cycle 38*a* corresponds to the number of rows of pixels within the electroluminescent panel 10. The first write cycle 38*a* is followed by a first refresh pulse 43*a* simultaneously written to all pixels within the electroluminescent panel 10.

The first write pulses 44*a* and the first refresh pulse 43*a* are opposite in polarity and may form a first frame 39*a*. In addition, applying write pulses 44*a* with a polarity opposite of the refresh pulses 43*a* reduces ghost images by canceling an electrical charge which accumulates at the interface of one of the first dielectric layer 14 or the second dielectric layer 16.

Thereafter, a second frame 39*b* including a plurality of second write pulses 44*b* forming a second write cycle 38*b* and a second refresh pulse 43*b* is applied to the pixels within the electroluminescent panel 10. Each write pulse 44*a* has the same polarity and each refresh pulse 43*a* has the same polarity as shown in FIG. 4. An asymmetrical voltage drive scheme repeats this sequence of voltage pulses to create images within the electroluminescent display.

Accordingly, two pulses of light are emitted from a pixel during each frame 39 when the asymmetrical voltage drive scheme is utilized (i.e. refresh pulse 43 and write pulse 44) as opposed to a single pulse of light during each write cycle 38 when the symmetrical voltage drive scheme is utilized (i.e. either a negative write voltage 41 or positive write voltage 42).

Therefore, the electroluminescent display is brighter when driven by an asymmetrical voltage drive scheme and it is therefore preferred to utilize an asymmetrical voltage drive scheme to illuminate the pixels within the electroluminescent panel 10.

Figure 5:
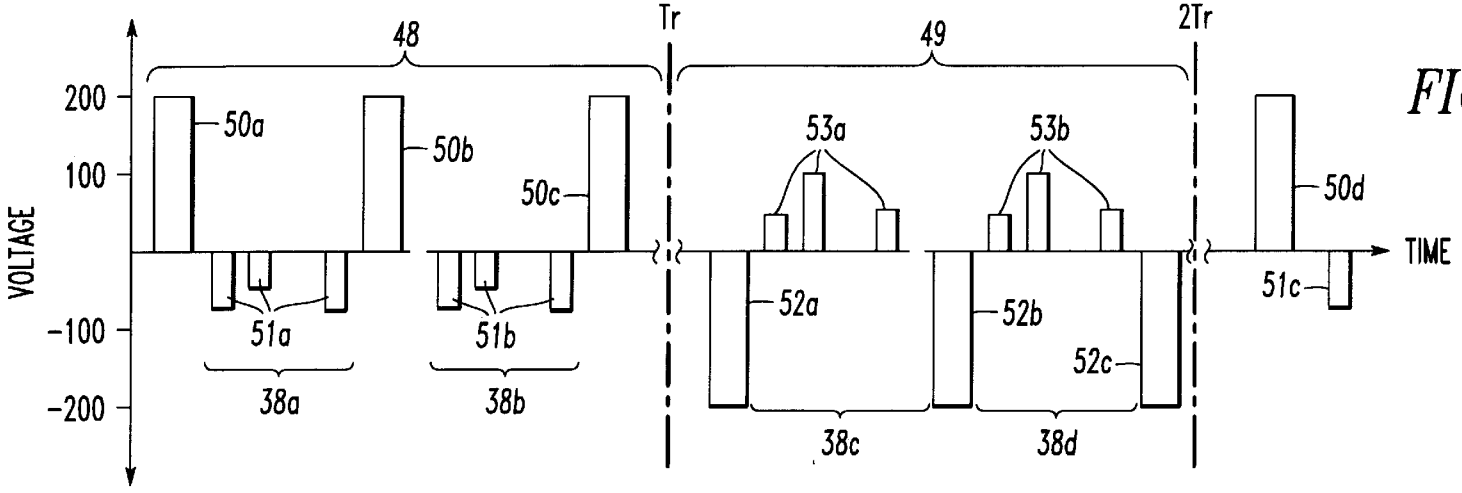
FIG. 5 is a plot of an embodiment of a waveform of the voltage drive scheme in accordance with the present invention.

An embodiment of a modified asymmetric voltage drive scheme in accordance with the present invention is shown in FIG. 5. The modified asymmetric voltage drive scheme may be utilized with either graphic style electroluminescent panels 10 or gray scale electroluminescent panels 10.

The modified asymmetric voltage drive scheme in accordance with the present invention may include patterns (a first pattern 48 and a second pattern 49 are shown in FIG. 5).

The sequence of voltage pulses within the first pattern 48 of the modified asymmetric voltage drive scheme may include a first refresh pulse 50*a* which may be simultaneously applied to all pixels. The first pattern may next include a plurality of first negative write pulses 51*a* which are individually applied to a corresponding row of pixels. The negative write pulses 51 and the positive write pulses 53 may form write cycles 38 as shown in FIG. 5.

The first pattern 48 may additionally include a second refresh pulse 50*b* followed by a second write cycle 38*b* which has a plurality of second negative write pulses 51*b*. This sequence repeats for a period of time thereby defining the first pattern 48.

At the transition times T=Tr, 2Tr, etc., the polarity of the modified asymmetrical voltage drive scheme may be reversed as shown in FIG. 5. Following the transition time Tr on the voltage waveform plot, the sequence of pulses follow a second pattern 49 of the modified asymmetrical voltage drive scheme in accordance with the present invention.

A second pattern 49 preferably includes a first negative refresh pulse 52*a* which may be applied to all pixels. The first negative refresh pulse 52*a* may be followed by a plurality of first positive write pulses 53*a* which define a third write cycle 38*c*.

This sequence is followed for a second period of time thereby defining a second pattern 49. The polarity of the voltage pulses is reversed after the second pattern 49 at time 2Tr as shown in FIG. 5. The number of voltage pulses 50, 51 within the first pattern 48 and the number of voltage pulses 52, 53 within the second pattern 49 are preferably equal but may be varied.

The voltage pulse generated immediately prior to the transition time Tr is preferably inverted and repeated following the transition time Tr. For example, as shown in FIG. 5, a positive refresh pulse 50 may be applied to the electroluminescent panel 10 at a moment in time just prior to the transition time Tr and a negative refresh pulse 52 may immediately follow the transition time Tr.

Figure 6:
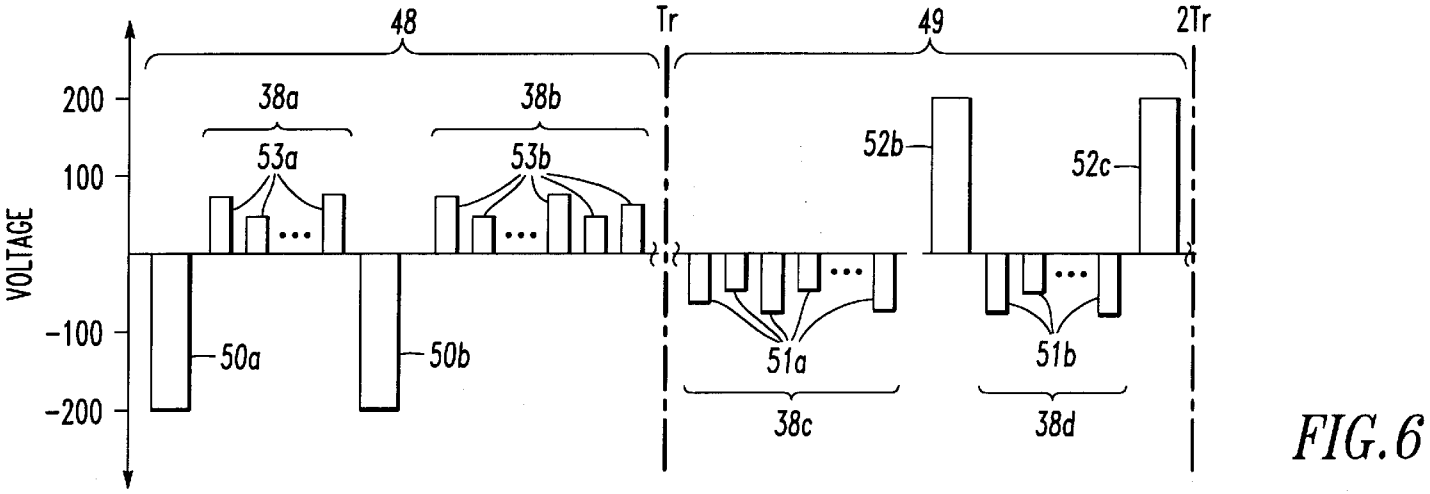
FIG. 6 is another plot of an embodiment of a waveform of the voltage drive scheme in accordance with the present invention.

Alternatively, a write cycle 38 of positive write voltage pulses 53 may be applied to the electroluminescent panel 10 at a moment in time just prior to the transition time Tr and a write cycle 38 of negative write voltage pulses 51 may immediately follow the transition time as shown in FIG. 6.

Any preferential interface charge distributions which have accumulated prior to the transition times Tr, 2Tr, etc. may form latent images on the electroluminescent panel 10. Such a preferential interface charge distribution may be neutralized by an opposite preferential charge built up at an opposite interface after the transition times Tr, 2Tr, etc. Accordingly, the latent images on the electroluminescent panel 10 are greatly reduced.

A variety of methods for calculating the timing of the transition times Tr, 2Tr, etc. may be utilized. Preferably, the polarity of the voltage pulses may be reversed before the latent image formation becomes objectionable. Additionally, display system usage and architecture will affect the time at which the polarity must be reversed.

Preferably, a sequence of voltage pulses may be defined wherein the first pattern 48 and second pattern 49 include an equal number of voltage pulses and the polarity may be reversed within every few minutes. Alternatively, the sequence of pulses may include a first pattern 48 and a second pattern 49 wherein the polarity of the voltage pulses may be reversed after the application of a second refresh pulse 50, 52 or a second write cycle 38 within the pattern. In addition, the polarity of the pulses may be alternated whenever the electroluminescent display is turned off and on.

The electroluminescent display preferably includes a polarity reverser 23 to invert the polarity of the voltage pulses. A polarity reverser 23 may be coupled with the waveform generator 22 and the row driver 26 and the column driver 28 as shown in FIG. 2. In addition, the polarity reverser 23 may be coupled with a timer 19 which calculates the transition times Tr, 2Tr, etc. for reversing the polarity of the voltage drive pulses. Alternatively, the waveform generator 22 may instruct the polarity reverser 23 to reverse the polarity via a third line 27.

The polarity reverser 23 may be configured to reverse the polarity of the voltage pulses when the electroluminescent display is turned off or on to simplify the electroluminescent display hardware.

The polarity reverser 23 may receive power from a power supply 29 and apply the power to the row driver 26 and the column driver 28. The polarity reverser 23 may reverse the polarity of the power applied to the row driver 26 and the column driver 28 at the transition times Tr, 2Tr, etc. Accordingly, the polarity of the write pulses 51, 53 and the refresh pulses 50, 52 applied to the pixels is reversed when the polarity of the power applied to the row driver 26 and the column driver 28 is reversed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting to the scope of the invention which is to be given the full breadth of the following claims and all equivalents thereof.

We claim:

1. An electroluminescent display, comprising:

a. an electroluminescent layer having a first side and a second side;

b. a waveform generator to produce a plurality of voltage signals;

c. a plurality of first electrodes coupled to said waveform generator to apply the voltage signals to the first side of said electroluminescent layer;

d. a plurality of second electrodes coupled to said waveform generator to apply the voltage signals to the second side of said electroluminescent layer;

e. a polarity reverser to selectively invert the polarity of the voltage signals thereby reducing the formation of latent images within the electroluminescent display; and wherein the voltage signals are applied in a plurality of time periods separated by a transition time period, wherein each time period includes a plurality of write cycles, each including at least one write pulse, and a plurality of refresh pulses, the write pulses being of opposite polarity to the refresh pulses, and wherein the last voltage signal of a time period immediately prior to a transition time is inverted and applied as a first voltage signal of the next time period.

2. The electroluminescent display of claim 1 wherein each of the write cycles includes a threshold voltage pulse sequentially applied to said first electrodes and wherein the write pulses and the refresh pulses are applied to said second electrodes.

3. The electroluminescent display of claim 1 further comprising:

a. a row driver interposed between said waveform generator and said first electrodes; and b. a column driver interposed between said waveform generator and said second electrodes; wherein said polarity reverser is coupled with said row driver and said column driver to control the polarity of the voltage signals applied to the electroluminescent layer.

4. The electroluminescent display of claim 1 further comprising a power supply connected to said polarity reverser.

5. The electroluminescent display of claim 1 further comprising a timer coupled with said polarity reverser to time the reversal of the polarity of the voltage signals.

6. An apparatus to drive an electroluminescent panel and reduce the formation of latent images therein, comprising:

a. a waveform generator to produce a plurality of voltage signals;

b. a row driver coupled with said waveform generator to apply a portion of the voltage signals to the electroluminescent panel;

c. a column driver coupled with said waveform generator to apply a portion of the voltage signals to the electroluminescent panel;

d. a polarity reverser coupled with said row driver and said column driver to periodically invert the polarity of the voltage signals and thereby reduce the formation of latent images within the electroluminescent panel; and, wherein the voltage signals are applied in a plurality of time periods separated by a transition time period, wherein each time period includes the write pulses being of opposite polarity to the refresh pulses, a plurality of write cycles and a plurality of refresh pulses and wherein the write cycles include a plurality of write pulses which are opposite in polarity and wherein the last voltage signal of a time period immediately prior to a next transition time is inverted and applied as a first voltage signal of the next time period.

7. The apparatus of claim 6 further comprising a plurality of first electrodes connected to said row driver and a plurality of second electrodes connected to said column driver and wherein each write cycle includes a threshold voltage pulse sequentially applied to said first electrodes and wherein said plurality of write pulses are applied to said second electrodes.

8. The apparatus of claim 6 further comprising a power supply connected with said polarity reverser.

9. The apparatus of claim 6 further comprising a timer coupled with said polarity reverser to time the reversal of the polarity of the voltage signals including the write pulses and the refresh pulses.

10. A method of reducing latent images within an electroluminescent panel having a plurality of first electrodes and a plurality of second electrodes, comprising the steps of:

(a) applying a first pattern of voltage pulses to the electroluminescent panel during a first time period;

(b) applying a second pattern of voltage pulses to the electroluminescent panel during a subsequent second time period and having respective polarity opposite like pulses of said first pattern of voltage pulses, said first and second time period being separated by a transition time period;

wherein said first and second pattern of voltage pulses comprise at least one refresh pulse and at least one write cycle including at least one write pulse, said at least one refresh pulse and said at least one write pulse further being of mutually opposite polarity;

(c) inverting the polarity of the last voltage pulse of said first pattern of voltage pulses applied immediately prior to the transition time period; and (d) applying the inverted polarity voltage pulse as a first pulse to the second pattern of pulses immediately following the transition time period.

11. The method of claim 10 wherein the voltage pulse applied immediately prior to the transition time period comprises a refresh pulse.

12. The method of claim 10 wherein the voltage pulse applied immediately prior to the transition time comprises a write pulse.

13. The method of claim 10 wherein said first and second pattern of voltage pulses comprises a plurality of refresh pulses and a plurality of write cycles and wherein each of said write cycles include a plurality of write pulses of the same polarity.

14. The method of claim 10 further comprising the step of repeating the application of the first and second pattern of voltage pulses for a predetermined number of consecutive time separated by respective transition time periods.

15. The method of claim 14 wherein the time of applying the refresh pulses and write pulses in each said time period interval is sufficiently short in duration to prevent the formation of latent images within the electroluminescent panel.

16. The method of claim 10 wherein another refresh pulse immediately follows the at least one initial write cycle of said first and second time period.

* * * * *